US005186556A

United States Patent [19]

Koyanagi

[11] Patent Number: 5,186,556

[45] Date of Patent: Feb. 16, 1993

[54] PAPER SHEET GUIDE FOR A PRINTER

[75] Inventor: Masayoshi Koyanagi, Shizuoka, Japan

[73] Assignee: Tokyo Electric Co., Ltd., Tokyo, Japan

[21] Appl. No.: 794,386

[22] Filed: Nov. 19, 1991

[30] Foreign Application Priority Data

Nov. 22, 1990 [JP] Japan ..... 2-318945

[51] Int. Cl.[5] ..... B41J 13/14

[52] U.S. Cl. ..... 400/642; 400/605; 400/607

[58] Field of Search ..... 400/642, 605, 607

[56] References Cited

U.S. PATENT DOCUMENTS 4,437,780 3/1984 Weber .
4,725,857 2/1988 Piatt et al. ..... 400/605
4,773,782 9/1988 Hirano ..... 400/642
4,854,757 8/1989 Kikuchi ..... 400/605
4,909,497 3/1990 Itabashi et al. ..... 400/605
5,000,598 3/1991 Jingu et al. ..... 400/642

FOREIGN PATENT DOCUMENTS 2387781 11/1978 France .

*Primary Examiner*—Edgar S. Burr
*Assistant Examiner*—Lynn D. Hendrickson
*Attorney, Agent, or Firm*—Frishauf, Holtz, Goodman & Woodward

[57] ABSTRACT

A printer includes an outer case housing a printing head and a platen and being provided with a paper sheet introducing opening. A paper sheet introducing guide is mounted on the outer case to guide a paper sheet introduced into the introducing opening to a position adjacent to the platen. A paper sheet intermediate guide is mounted within the outer case to guide the paper sheet from the distal end of the introducing guide to a gap between the platen and the printing head. A paper sheet auxiliary guide extends from the intermediate guide to the upper surface of the distal end portion of the introducing guide.

4 Claims, 4 Drawing Sheets

PAPER SHEET GUIDE FOR A PRINTER

BACKGROUND OF THE INVENTION

1. Field of the Invention

This invention relates generally to a printer, and more particularly to a printer in which a recording paper sheet introduced from a sheet introducing opening is guided by sheet guiding means to a portion between a platen and a printing head and discharged from a sheet discharging opening after data has been printed on the paper sheet by the printing head.

2. Description of the Related Art

FIG. 4 is a schematic view of an independent printer unit of conventional type as mentioned above. This printer is capable of printing data on continuous paper having rows of pin holes formed on both side thereof, or on a paper sheet of a predetermined size.

A cylindrical platen 12 is rotatably mounted in a horizontal position in a central portion of an outer case 10 of the printer. On one side of the platen 12, a printing head 14 is mounted and is movable parallel to the platen 12 in a longitudinal direction thereof.

A region in an upper surface of the outer case 10, which corresponds to the platen 12 and the printing head 14, is constructed as a main upper cover 18. The main upper cover 18 is pivotable on an axis 16 which is remote from the platen 12 and the printing head 14. When the main upper cover 18 is raised, the platen 12 and the printing head 14 in the outer case 10 can be accessed from above.

First and second pinch roller groups 20 and 22 are positioned under the platen 12 so as to be spaced apart form each other in a radial direction of the plate 12, and in contact therewith.

An another region in the upper surface of the outer case 10, which is located on the opposite side of the platen 12 concerning to the printing head 14 and does not correspond to the platen 12 and the printing head 14, is constructed as a paper sheet introducing guide 24. The paper sheet introducing guide 24 is so inclined that the end portion thereof, which is adjacent to the platen 12, is directed toward a contact position between the platen 12 and the first pinch roller group 20. The end of the paper sheet introducing guide 24 and the outer periphery of the platen 12 define a paper sheet introducing opening 26.

As is clearly shown in FIG. 5, a paper sheet intermediate guide 28 is arranged under the outer periphery of the platen 12, and extends along the outer periphery of the platen 12 with it being slightly spaced apart from the platen between the second and the first pinch roller groups 22 and 20. The base end of the paper sheet intermediate guide 28 extends under the paper sheet introducing guide 24 to go away from the platen 12.

A paper sheet presser 30 is arranged between the printing head 14 and the proximal end of the paper sheet intermediate guide 28 so as to contact the outer periphery of the platen 12.

A paper sheet (not shown), which is slid down on the paper sheet introducing guide 24 into the paper sheet introducing opening 26 while the platen 12 is rotated in the clockwise direction in FIGS. 4 and 5, is pinched between the platen 12 and the first pinch roller group 20. As the platen 12 continues its rotation in this direction, the paper sheet is pinched between the platen 12 and the second pinch roller group 22, then pressed on the outer periphery of the platen 12 by the paper sheet presser 30, and thereafter passes through a very narrow space between the distal end of the printing head 14 (which is not moving) and the outer periphery of the platen 12.

If, after the leading end of the paper sheet reaches the printing head 14, an input device (not shown) supplies a printing order to the printer, the printing head 14 moves at a predetermined speed from one end to the other end of the platen 12 in the longitudinal direction thereof, and prints data on the paper sheet in accordance with the order. After the printing head 14 has reached at the other end, it returns to the above described one end. During this return, the platen 12 rotates clockwise by a predetermined angle at a given speed so as to move the paper sheet by a specified distance in a circumferential direction of the platen 12. After that, the above described printing of the printing head 14 on the paper sheet and the movement of the paper sheet by the given distance by the platen 12 are repeated until no further printing order is supplied.

A pin feed tractor 32 for supplying continuous paper having rows of pin holes on both sides thereof is arranged on the opposite side of the platen 12 concerning to the printing head 14 in the outer case 10.

The region of the upper surface of the outer case 10, which is located on the opposite side of the platen 12 concerning to the printing head 14 and has the paper sheet introducing guide 24, faces the pin feed tractor 32, and is constructed as a sub-upper cover 34. The sub-upper cover 34 is pivotable on an axis which is remote from the platen 12 and the printing head 14. When the sub-upper cover 34 is raised, the pin feed tractor 32 in the outer case 10 can be accessed from above. The sub-upper cover 34 has a continuous paper introducing opening 36 for permitting continuous paper to be supplied to the pin feed tractor 32.

A continuous paper guide 38 is arranged under the paper sheet intermediate guide 28 so as so extend along the guide 28 between an exit of the pin feed tractor 32 and the paper sheet presser 30. When continuous paper is supplied by the pin feed tractor 32, the first and second pinch roller groups 20 and 22 are detached from the platen 12, i.e., removed from a continuous-paper passage between the continuous paper guide 38 and the paper sheet intermediate guide 28.

The pin feed tractor 32 intermittently moves the continuous paper in association with intermittent rotation of the platen 12 during the printing operation by the printing head 14.

Paper sheet or continuous paper on which data have been recorded are discharged by the intermittent feeding operation of the platen 12 or the pin feed tractor 32 to the outside of the printer through a paper discharge opening 40 defined between the upper end of the outer periphery of the platen 12 and the main upper cover 18 of the outer case 10.

In the conventional printer as described above, if the platen 12 is rotated in the reverse direction to feed the paper sheet backward after the rear end of the paper sheet has been introduced into the paper sheet introducing opening 26, the rear end of the paper sheet is caught in the gap between the paper sheet intermediate guide 28 and the distal end of the paper sheet introducing guide 24 so that the paper sheet cannot be further transferred backward. As a result, the rear end portion of the paper sheet is jammed at the paper sheet introducing opening 26. Works for removing the jammed paper sheet from the paper sheet introducing opening 26 is cumbersome. In addition, the jammed paper sheet cannot be used thereafter, due to folds, etc.

Reverse feeding of a paper sheet is necessary to correct the print start position or print correct start position on the paper sheet or the posture of the paper sheet when the paper sheet is oblique on the platen.

SUMMARY OF THE INVENTION

The present invention is derived from the above situation, and its object is to provide a printer wherein if a paper sheet is to be transferred backward after the rear end thereof has already been introduced into the paper sheet introducing opening, the rear end portion of the paper sheet will not hinder the reverse feeding of the paper sheet, thereby preventing the rear end of the paper sheet from jamming at the paper sheet introducing opening and making it possible to reuse the paper sheet which has been transferred backward.

To achieve the above object, the printer according to the present invention comprises: a printing head; a platen; an outer case housing the printing head and the platen and being provided with a paper sheet introducing opening; a paper sheet introducing guide, mounted on the outer case, for guiding a paper sheet introduced into the paper sheet introducing opening to a position adjacent to the platen; a paper sheet intermediate guide, mounted within the outer case, for guiding the paper sheet from the distal end of the paper sheet introducing guide to a gap between the platen and the printing head; and a paper sheet auxiliary guide formed in the paper sheet intermediate guide and extending therefrom to the upper surface of the distal end portion of the paper sheet introducing guide.

In the case of the printer according to the invention and characterized by being constructed as described above, if a paper sheet is to be transferred backward by rotating the platen in the reverse direction after the rear end of the paper sheet has already been introduced into the paper sheet introducing opening, the rear end portion of the paper sheet is reliably guided by the paper sheet auxiliary guide to the upper surface of the distal end portion of the paper sheet introducing guide when the paper sheet is transferred backward, and therefore does not enter into the gap between the paper sheet intermediate guide and the distal end of the paper sheet introducing guide. Accordingly, reverse feeding of the paper sheet is not prevented, so that the rear end portion of the paper sheet is not jammed at the paper sheet introducing opening, and the paper sheet which has been transferred backward without it being jammed can be reused, since it is not folded.

In the printer of the invention, it is preferable that the paper sheet auxiliary guide is integrally formed with the paper sheet intermediate guide by partially cutting the paper sheet intermediate guide and raising upward the cut. Integral forming of the paper sheet auxiliary guide with the paper sheet intermediate guide makes a forming step for these guide simple.

In the printer of the invention, it is further preferable that the paper sheet auxiliary guide has a plurality of raises integrally formed with the paper sheet intermediate guide by partially cutting the paper sheet intermediate guide at a plurality of portions and raising the cuts, a plurality of notches are formed in the distal end of the paper sheet introducing guide so as to correspond to the raises of the paper sheet auxiliary guide, and the raises of the paper sheet auxiliary guides are inserted in the notches in the distal end of the paper sheet introducing guide.

This structure permits a portion of the outer wall of the outer case including the paper sheet introducing guide to serve as a cover.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrates a presently preferred embodiment of the invention and, together with the general description given above and the detailed description of the preferred embodiment given below, serve to explain the principles of the invention.

DETAILED DESCRIPTION OF THE PREFERRED EMBODIMENTS

An embodiment of the present invention will now be described with reference to FIGS. 1 to 3.

Figure 1:
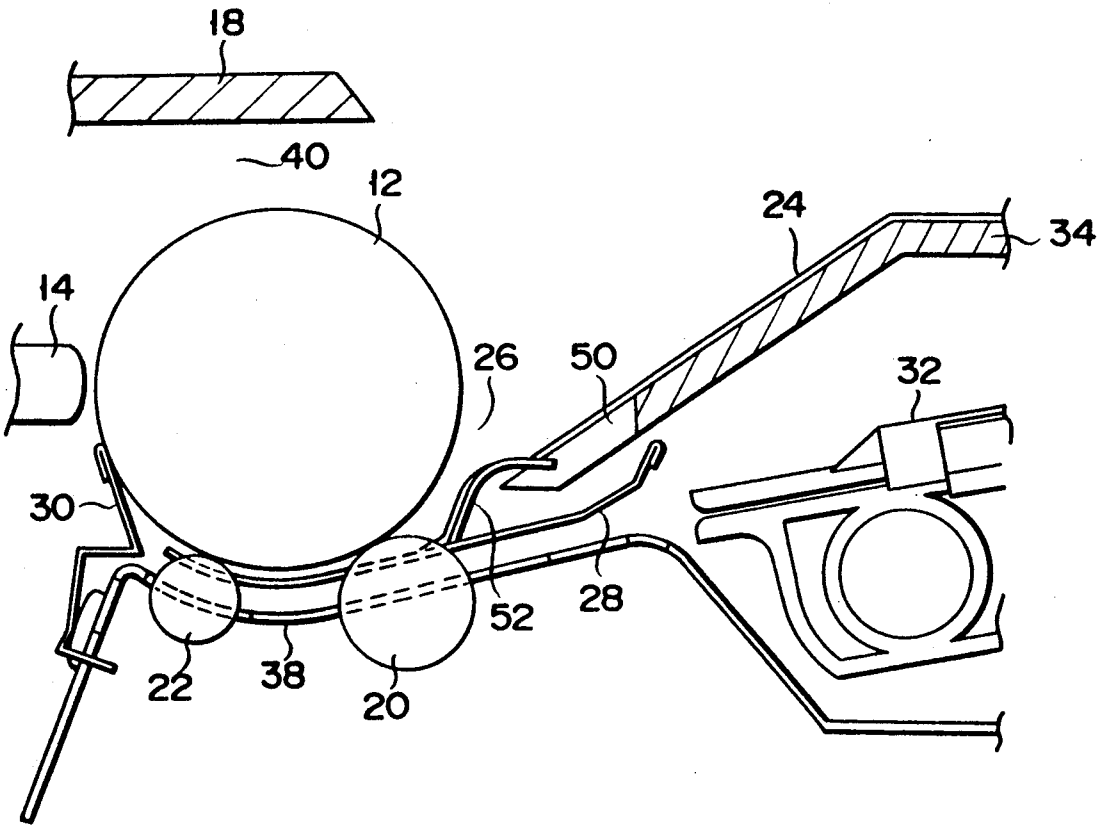
FIG. 1 is a longitudinally-sectional view schematically showing a main part of a printer according to an embodiment of the present invention.
Figure 4:
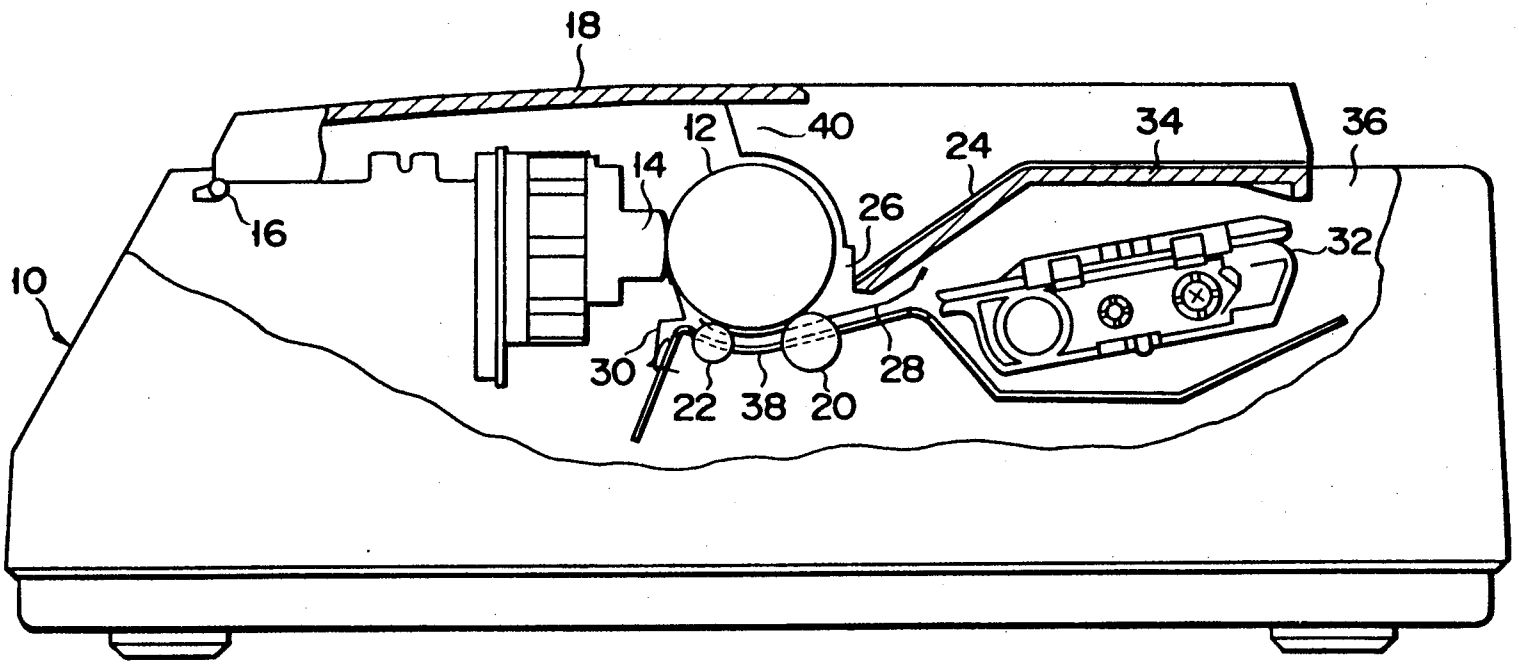
FIG. 4 (PRIOR ART)
FIG. 4 is a longitudinally-sectional view schematically showing the overall structure of a conventional printer.
Figure 5:
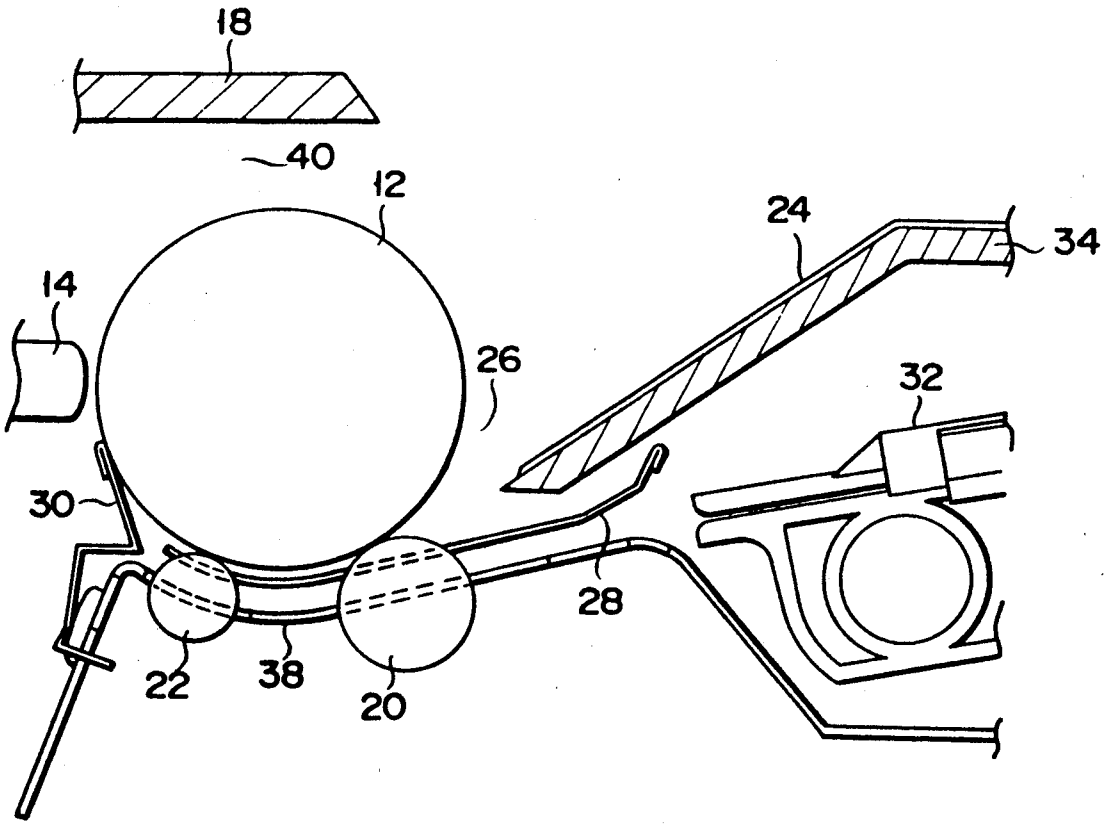
FIG. 5 (PRIOR ART)
FIG. 5 is a longitudinally-sectional view schematically showing a main part of the conventional printer shown in FIG. 4.

FIG. 1 schematically shows a main part of a printer according to an embodiment of the present invention. This embodiment includes the same elements as used in the conventional printer described, with reference to FIGS. 4 and 5. The common elements are identified by the same reference numerals as in the conventional printer and detailed descriptions thereof are omitted.

Figure 2:
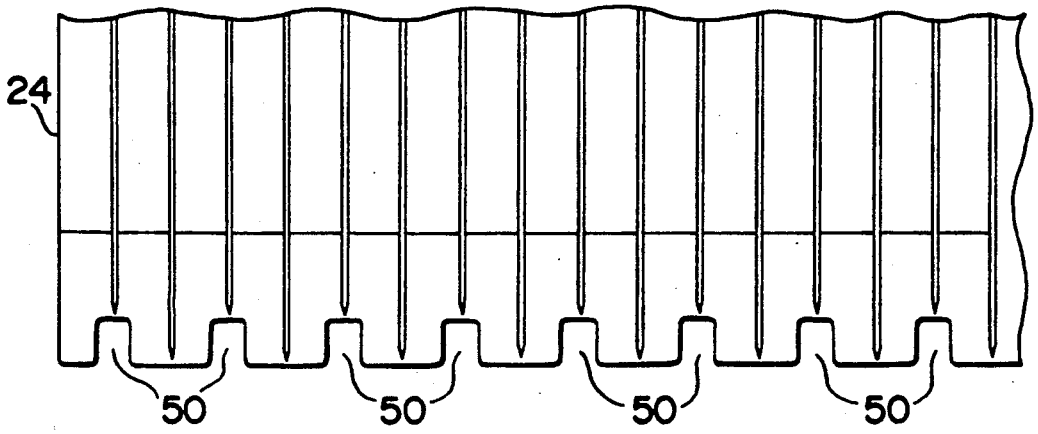
FIG. 2 is a plan view showing a distal end portion of a paper sheet introducing guide shown in FIG. 1, in which a plurality of notches formed in the distal end portion are clearly shown.
Figure 3:
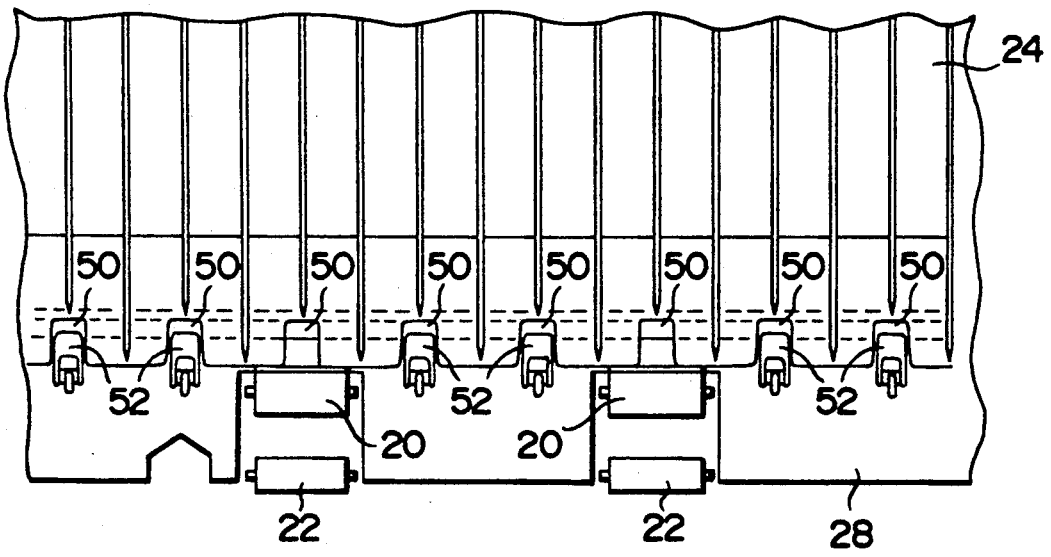
FIG. 3 is a plan view showing a state where a plurality of raises of a paper sheet auxiliary guide formed in the paper sheet intermediate guide shown in FIG. 1 are inserted in the plural notches of the distal end portion of the paper sheet introducing guide shown in FIG. 1.

According to the embodiment, as is clearly shown in FIG. 2 in particular, a plurality of notches 50 are formed in the distal end of the paper sheet introducing guide 24 at a plurality of positions spaced apart from one another in the longitudinal direction of the platen 12. A plurality of raises are formed in the paper sheet intermediate guide 28 so as to the correspond to the plural notches 50 of the paper sheet introducing guide 24. These raises are partially cut and bent upward from the intermediates guide 28, and inserted into the notches from underneath, as is shown in FIGS. 1 and 3. These raises construct a paper sheet auxiliary guide 52.

The raises of the paper sheet auxiliary guide 52 gradually rise and then gradually drop with these raises extending away from the lower end of the outer periphery of the platen 12. As is shown in FIG. 1, the peaks of the raises of the paper sheet auxiliary guide 52 protrude above the upper surface of the paper sheet introducing guide 24 in the corresponding notches 50, and their distal ends extend to a portion lower than the upper surface of the paper sheet introducing guide 24 in the corresponding notches 50.

In the printer according to the embodiment of the invention and constructed as described above, when the platen 12 is rotated in the reverse direction to transfer a paper sheet backward in a state where the rear end of the paper sheet has already been introduced into the paper sheet introducing opening 26, the rear end of the paper sheet is raised above the upper surface of the distal end portion of the paper sheet introducing guide 24 by the raises of the paper sheet auxiliary guide 52. When the paper sheet is transferred further back, the rear end of the paper sheet hangs down on the upper surface of the paper sheet introducing guide 24 and is guided upward along it.

In this manner, the rear end of the paper sheet is prevented from entering into the gap between the paper sheet intermediate guide 28 and the distal end portion of the paper sheet introducing guide 24 by virtue of the paper sheet auxiliary guide 52 when the paper sheet is transferred backwardly under the condition as described above. As a result, back-feeding of the paper sheet is performed smoothly, and the rear end of the paper sheet is prevented from being jammed at the paper sheet introducing opening 26.

Since the paper sheet which has been fed backward without jamming is not folded, it can be reused.

When a paper sheet slips down along the upper surface of the paper sheet introducing guide 24 toward the paper sheet introducing opening 26, the distal end portions of the raises of the auxiliary guide 52, which gradually drop from their tops, float the front end of the paper sheet from the upper surface of the paper sheet introducing guide 24 and direct it toward the platen 12. However, the front end of the paper sheet is brought into contact with the outer periphery of the platen 12, thereby directing it to the paper sheet introducing opening 26. The inclination of each of the distal end portions of the raises of the paper sheet auxiliary guide 52 is not so steep as to prevent the front end of the paper sheet from moving downward.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A paper sheet guide for a printer, the printer including a printing head, a platen and an outer case that houses the printing head and said platen, said outer case including a paper sheet introducing opening, said paper sheet guide comprising:

a paper sheet introducing guide, mounted on the outer case, for guiding a paper sheet introduced into the paper sheet introducing opening to a position adjacent to the platen;

a paper sheet intermediate guide, mounted within the outer case, for guiding the paper sheet from a distal end portion of said paper sheet introducing guide to a gap formed between the platen and the printing head; and a paper sheet auxiliary guide having an upper surface, said paper sheet auxiliary guide extending from said paper sheet intermediate guide such that a first obtuse angle is formed between the upper surface of the paper sheet auxiliary guide and an upper surface of said paper sheet intermediate guide;

said paper sheet auxiliary guide intersecting an upper surface of the distal end portion of said paper sheet introducing guide such that a second obtuse angle is formed between the upper surface of said paper sheet auxiliary guide and an upper surface of said paper sheet introducing guide, whereby a paper sheet guided by said paper sheet guide in one of a direction toward said gap and a direction away from said gap, will move over the first and second obtuse angles without causing a paper jam.

2. A paper sheet guide for a printer according to claim 1, wherein said paper sheet auxiliary guide is formed integrally with said paper sheet intermediate guide, and further comprising partially cut-out portions formed on said paper sheet intermediate guide, said partially cut-out portions being raised to be above a plane of a top surface of the paper sheet intermediate guide.

3. A paper sheet guide for a printer according to claim 1, wherein:

said paper sheet auxiliary guide has a plurality of raised portions;

said paper sheet auxiliary guide is formed integrally with said paper sheet intermediate guide;

said paper sheet intermediate guide has a plurality of partially cut-out portions formed therein;

said plurality of cut-out portions of said paper sheet intermediate guide are uplifted to be above a plane of a top surface of said paper sheet intermediate guide;

a plurality of notches are formed in the distal end portion of said paper sheet introducing guide such that said notches are positioned to correspond respectively with a respective one of said raised portions of said paper sheet auxiliary guide; and each of said uplifted cut-out portions of said paper sheet auxiliary guide is positioned in a respective one of said plurality of notches.

4. A paper sheet guide for a printer according to claim 1, wherein said paper sheet auxiliary guide has a composite shape that includes:

a first bent portion that is bent in an upward direction away from said paper sheet intermediate guide; and a second bent portion that is curved downwardly to intersect the upper surface of the distal end portion of said paper sheet introducing guide.

* * * * *